US009333524B2

(12) United States Patent
Somada et al.

(10) Patent No.: US 9,333,524 B2
(45) Date of Patent: May 10, 2016

(54) SLOT CURTAIN COATING APPARATUS AND SLOT CURTAIN COATING METHOD

(71) Applicants: Hiroki Somada, Shizuoka (JP); Kazuhisa Yamamoto, Shizuoka (JP)

(72) Inventors: Hiroki Somada, Shizuoka (JP); Kazuhisa Yamamoto, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/200,509

(22) Filed: Mar. 7, 2014

(65) Prior Publication Data

US 2014/0272160 A1 Sep. 18, 2014

(30) Foreign Application Priority Data

Mar. 15, 2013 (JP) ..... 2013-053145

(51) Int. Cl.

| | |
|---|---|
| ***B05C 5/00*** | (2006.01) |
| ***B05D 1/30*** | (2006.01) |
| ***B05C 11/10*** | (2006.01) |
| *G03C 1/74* | (2006.01) |

(52) U.S. Cl.

CPC ..... *B05C 5/005* (2013.01); *B05C 5/007* (2013.01); *B05C 11/1039* (2013.01); *G03C 1/74* (2013.01); *Y10S 118/04* (2013.01)

(58) Field of Classification Search

None

See application file for complete search history.

(56) References Cited

U.S. PATENT DOCUMENTS

| | | | | |
|---|---|---|---|---|
| 4,974,533 | A | 12/1990 | Ishizuka et al. | |
| 5,358,569 | A * | 10/1994 | Conroy et al. | 118/DIG. 4 |
| 6,287,384 | B2 * | 9/2001 | Oki et al. | 118/DIG. 4 |
| 7,081,163 | B2 | 7/2006 | Metzger et al. | |
| 2004/0047999 | A1 | 3/2004 | Gugler et al. | |
| 2007/0137563 | A1 | 6/2007 | Schweizer et al. | |
| 2010/0021645 | A1 | 1/2010 | Kobori et al. | |
| 2011/0059254 | A1 * | 3/2011 | Somada et al. | 118/300 |
| 2012/0251731 | A1 | 10/2012 | Yamamoto et al. | |

FOREIGN PATENT DOCUMENTS

| | | |
|---|---|---|
| JP | 01-199668 | 8/1989 |
| JP | 06-218314 | 8/1994 |
| JP | 2001-046939 | 2/2001 |
| JP | 2004-105960 | 4/2004 |
| JP | 2008-529753 | 6/2008 |
| JP | 2010-022947 | 2/2010 |
| JP | 2011-078966 | 4/2011 |
| JP | 2012-035210 | 2/2012 |

* cited by examiner

*Primary Examiner* — Binu Thomas
(74) *Attorney, Agent, or Firm* — Cooper & Dunham LLP

(57) ABSTRACT

A slot curtain coating apparatus, including: ejecting unit containing coating liquid outlet to eject coating liquid; pair of guiding units, each containing auxiliary water outlet to eject auxiliary water, the guiding units being configured to support both edges of curtain film formed of the coating liquid ejected from the coating liquid outlet along width-direction substantially vertical to flow-down direction of the curtain film, and to guide the curtain film onto support transported; and transporting unit to transport the support, wherein the guiding unit has manifold portion to retain the auxiliary water, and slit portion connecting between the manifold portion and the auxiliary water outlet, the slit portion is composed of straight-line portion, and curved portion to eject the auxiliary water substantially vertically downwards, and curvature radius R of bottom part of the curved portion is 0.5 mm-3 mm, and the curved portion is provided to position at which h=T+R+S is 1.5 mm-5 mm.

6 Claims, 7 Drawing Sheets

SLOT CURTAIN COATING APPARATUS AND SLOT CURTAIN COATING METHOD

BACKGROUND OF THE INVENTION

1. Field of the Invention

The present invention relates to a slot curtain coating apparatus and a slot curtain coating method, in both of which a coating liquid ejected from a slit is applied on a continuously running web, while so guiding the coating liquid in the form of a curtain with curtain edge guides.

2. Description of the Related Art

As a coating film is formed in the slot curtain coating method, a portion where a flow of a coating liquid is slow, which is called a boundary layer, is created adjacent to both edge guides of a curtain film, when the coating liquid free falls. Due to this difference in the flow rate, a difference in surface tension is generated. A phenomenon that parts of the coating liquid adjacent to the both edges of the curtain film move towards the center is caused by Marangoni flow that is generated due to the surface tension difference. As a coating film is formed with hitting the coating liquid onto a continuously running web in the aforementioned state, there is a problem that thin film parts 20*a* are formed at edges of the coating film 20 with respect to the width direction thereof, as illustrated in FIG. 1.

For example, disclosed is a method for preventing a formation of a boundary layer in a curtain film (Japanese Patent Application Laid-Open (JP-A) No. 2008-520753). This method involves providing a porous material to a surface of an edge guide at which a curtain film is flown down, and ejecting auxiliary water from the porous material to cover the porous material with the auxiliary water, to reduce friction resistance of the curtain film with the surface of the edge guide at which the curtain film flows down, to prevent reduction in a flow-down speed of the coating liquid adjacent to the edge guides, to thereby prevent a formation of a boundary layer.

This method has an effect when a viscosity of the coating liquid is relatively low, such as a several tens cp. As a coating liquid having a high viscosity is used, however, a thickness of the film becomes uneven due to an influence of a boundary layer. Moreover, clogging of the porous material is caused with the coating liquid, and ejection of the edge guide auxiliary water becomes uneven, causing coating defects, such as uneven film thickness.

A method for solving the aforementioned clogging is disclosed in U.S. Pat. No. 7,081,163. Disclosed is a technique where a metal surface is provided as an auxiliary ater flow-down surface of the edge guide, and auxiliary water is ejected from an outlet provided in the metal surface.

The aforementioned technique however has a problem that it is hard to uniformly eject the edge guide auxiliary water, as it employs a structure where the edge guide auxiliary water is directly flown from the outlet, a problem that a curtain film is not stabilized, as the auxiliary water does not linearly fall and the auxiliary water flow-down surface is a flat surface, and a problem that a curtain film is swung by a disturbance of wind.

Moreover, disclosed in JP-A No. 2001-46939 in order to solve the problem that it is difficult to uniformly eject the edge guide auxiliary water is a method containing providing a slit portion and a manifold portion that is a liquid retention section, through which the edge guide auxiliary water pass until being ejected from the outlet. In this method, however, the ejection direction of the edge guide auxiliary water is different from the flow down direction of the coating liquid, and therefore the coating liquid cannot be sufficiently accelerated.

As for another method, disclosed is a method, in which a formation of a boundary layer is prevented adjacent to both edges of the curtain film by ejecting the edge guide auxiliary water to the edge guide in the flow-down direction of the coating liquid (JP-A No. 01-199668). In this method, however, acceleration of the curtain film with the edge guide auxiliary water is not sufficient, and therefore a boundary layer cannot be completely eliminated.

Moreover, it is also disclosed in JP-A No. 06-218314 that the edge guide auxiliary water is ejected to the edge guide in the flow-down direction of the coating liquid. This further discloses a size of a flow channel of the auxiliary water inside the edge guide. However, this disclosure does not include a speed of the edge guide auxiliary water. With regard to the size of the flow channel, the flow channel length and the radius R of the curved portion of the flow channel just before the outlet are disclosed. With such sizes, there is a significant difference to an obtainable effect of the present invention.

Furthermore, as a coating liquid having a relatively high viscosity and having a strong shear viscosity reducing effect, such as an adhesive, is used, a thickening effect of the slot curtain film due to an influence of a boundary layer increases.

Similarly to JP-A No. 06-218314, the edge guide auxiliary water is ejected in the curtain flow down direction in JP-A No. 2004-105960. However, there is no description about a radius R of the curved portion of the flow channel just before the outlet therein. Based upon the sizes of the flow channel of the auxiliary water and the outlet, or the size of the flow-down surface of the auxiliary water, an effect of reducing a boundary layer is not large with a coating liquid having a relatively high viscosity, and a strong shear viscosity educing effect, such as an adhesive.

Moreover, disclosed is an ejection speed of an edge guide auxiliary water at which an effect of accelerating a coating liquid is exhibited, a boundary layer is prevented so that an uneven thickness of a curtain film can be prevented with a coating liquid having a relatively high viscosity and a strong shear viscosity reducing effect, such as an adhesive (JP-A No. 2011-78966). In this disclosure, also disclosed are edge guides having resistance to disturbances, such as wind, i.e., a strong aligning effect, as a coating liquid having a relatively high surface tension (35 mN/m or greater) is used.

In the case where a coating liquid having a low surface tension (less than 35 mN/m) is used, disclosed are edge guide having resistance to disturbances, such as wind (JP-A No. 2012-35210).

An influence of a boundary layer is inhibited by flowing an auxiliary water along a surface of an edge guide at which a curtain film falls down, but there is no auxiliary water from the upper plane of the edge guide to the auxiliary water outlet. In the case where a coating liquid having a relatively high viscosity and strong shear viscosity reducing effect is applied, therefore, a boundary layer is easily generated between the aforementioned areas, and an influence of the boundary layer is caused, which have been found from the studies conducted by the present inventors.

The present inventors have come to an insight that an influence of a boundary layer adjacent to edge guides can be inhibited by reducing a distance between the top plane of the edge guide and the auxiliary water outlet. To reduce the distance between the top plane of the edge guide and the auxiliary water outlet, however, is not simple, as it is closely related to a flow channel for introducing auxiliary water.

In fact, a distance h from the top plane of the edge guide to the auxiliary water outlet is determined with $h=T+R+S$, which is a sum of a thickness T of the thinnest part of the upper part of the curved portion, a curvature radius R of the lower part of the curved portion from the straight-line portion to the auxiliary water outlet, and a thickness S of the slit portion, as illustrated in FIG. 2.

There is a problem of rigidity in order to reduce T, which is a thickness from the top plane of the edge guide to the slit portion. As a downside caused by reducing the curvature radius R of the lower part of the curved portion from the slit portion to the auxiliary water outlet, there is a problem that a flow in a flow channel in the curved portion becomes fast due to a centrifugal force, to thereby generate a disturbance in the flow. As a downside caused by reducing the thickness S of the slit portion, there is a problem that Reynolds number becomes large and a turbulent flow is caused.

SUMMARY OF THE INVENTION

The present invention aims to provide a slot curtain coating apparatus, which can make a thickness of a curtain film along a width direction uniform with preventing the curtain film from thickening or thinning adjacent to edge guide due to an influence of a boundary layer, to thereby improve a yield.

As for the means for solving the aforementioned problems, the slot curtain coating apparatus of the present invention contains:

an ejecting unit containing a coating liquid outlet configured to eject a coating liquid;

a pair of guiding units, each containing an auxiliary water outlet configured to eject auxiliary water, where the guiding units are configured to support both edges of a curtain film, which is formed of the coating liquid ejected from the coating liquid outlet, along a width direction that is substantially vertical to a flow-down direction of the curtain film, and to guide the curtain film onto a support to be transported; and a transporting unit configured to transport the support, wherein the guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and h is a height of the auxiliary water outlet from a top plane of the guiding unit.

The present invention can solve the aforementioned various problems in the art, achieve the aforementioned object, and can provide a slot curtain coating apparatus, which can make a thickness of a curtain film along a width direction uniform with preventing the curtain film from thickening or thinning adjacent to edge guide due to an influence of a boundary layer, to thereby improve a yield.

DETAILED DESCRIPTION OF THE INVENTION

Figure 1:
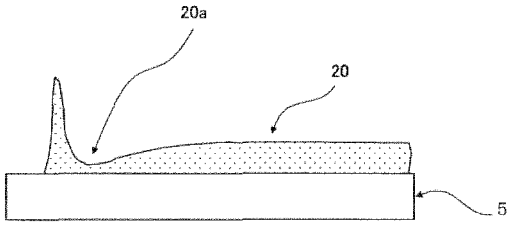
FIG. 1 is a diagram for explaining a thin film portion and thick film portion of a coating film.

One example of embodiments of the slot curtain coating apparatus and slot curtain coating method is explained hereinafter.

<Slot Curtain Coating Apparatus>

The slot curtain coating apparatus of the present invention contains an ejecting unit containing a coating liquid outlet configured to eject a coating liquid; a pair of guiding units, each containing an auxiliary water outlet configured to eject auxiliary water, where the guiding units are configured to support both edges of a curtain film, which is formed of the coating liquid ejected from the coating liquid outlet, along a width direction that is substantially vertical to a flow-down direction of the curtain film, and to guide the curtain film onto a support to be transported; and a transporting unit configured to transport the support, wherein the guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and h is a height of the auxiliary water outlet from a top plane of the guiding unit.

The thinnest part of the top part of the curved portion means a portion where a distance between a top plane of the guiding unit and the curved portion is the shortest.

The slot curtain coating apparatus of the present invention may further contain other units that are appropriately selected according to the necessity.

<Slot Curtain Coating Method>

The slot curtain coating method of the present invention contains: ejecting a coating liquid from a coating liquid outlet (ejection step); supporting both edges of a curtain film, which is formed of the coating liquid ejected from a coating liquid outlet, by a pair of guiding units each containing auxiliary water outlet configured to eject the auxiliary water, along a width direction that is substantially vertical to a flow-down direction of the curtain film, and guiding the curtain film onto a support to be transported (guiding step); and transporting the support (transportating step), wherein the guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and h is a height of the auxiliary water outlet from a top plane of the guiding unit.

The slot curtain coating method of the present invention may further contain other steps that are appropriately selected according to the necessity.

Structural elements of the slot curtain coating apparatus and slot curtain coating method of the present invention are explained hereinafter. The present invention is targeted for web coating.

Figure 2:
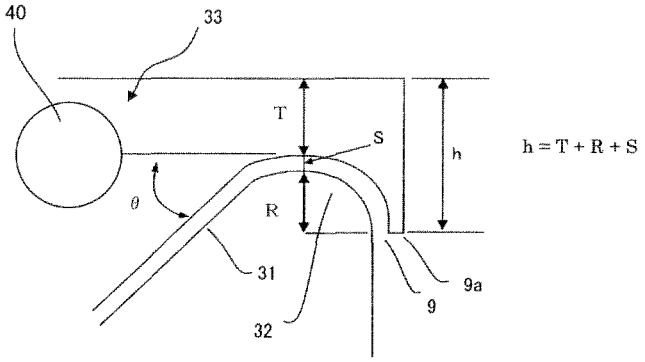
FIG. 2 is a cross-sectional view illustrating one example of a shape of a curved portion of a guiding unit in the slot curtain coating apparatus of the present invention.
Figure 3:
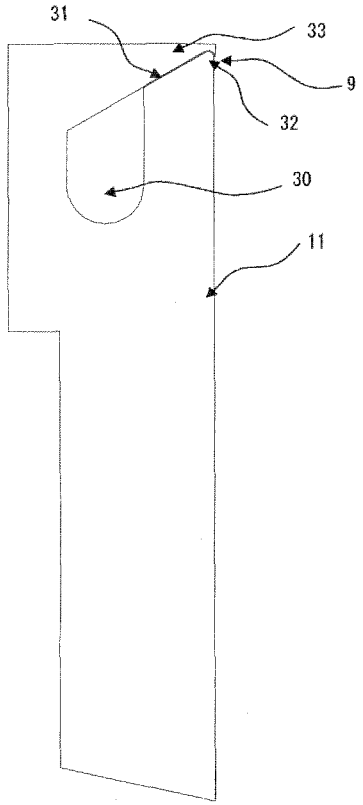
FIG. 3 is a cross-sectional view illustrating one example of an internal structure of the guiding unit in the slot curtain coating apparatus of the present invention.
Figure 4:
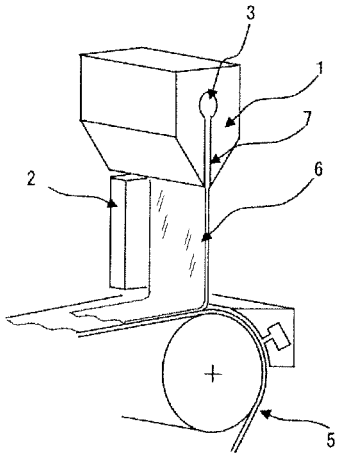
FIG. 4 is a schematic diagram illustrating one example of the slot curtain coating apparatus of the present invention.
Figure 5:
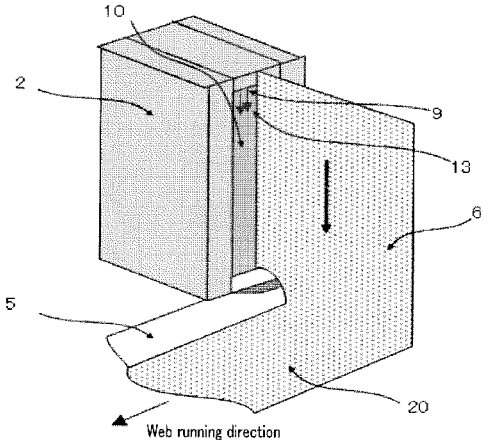
FIG. 5 is a diagram for explaining one example of the guiding unit in the slot curtain coating apparatus of the present invention.

FIG. 2 depicts a cross-sectional view of one example of a shape of the curved portion of the guiding unit in the slot curtain coating apparatus of the present invention. FIG. 3 depicts a cross-sectional view of one example of an internal structure of the guiding unit in the slot curtain coating apparatus of the present invention. FIG. 4 depicts a schematic diagram of one example of the slot curtain coating apparatus of the present invention.

<<Ejecting Unit, Ejection Step>>

The ejecting unit contains a manifold configured to retain a coating liquid, and a coating liquid outlet (slit) configured to eject the coating liquid.

The ejection step is ejecting the coating liquid from the coating liquid outlet to make a curtain film, which is formed of the coating liquid, fall.

—Coating Liquid—

The coating liquid is appropriately selected depending on the intended purpose without any limitation, but a fluid that reduces apparent viscosity as a shear rate increases, such as an acryl emulsion-based adhesive, exhibits a significant effect in the present invention.

A viscosity of the coating liquid is appropriately selected depending on the intended purpose. In order to sufficiently exhibits an effect of the present invention, however, the coating liquid is preferably a fluid that reduces apparent viscosity as a shear rate increases, and viscosity properties thereof are preferably in the ranges of $300 \leq \eta_1 \leq 3{,}000$ (mPa·sec), and $10 \leq \eta_2 \leq 300$ (mPa·sec), where $\eta_1$ is a viscosity of the coating liquid at a shear rate of 1 $sec^{-1}$, and $\eta_2$ is a viscosity thereof at a shear rate of 1,000 $sec^{-1}$.

When a viscosity of a coating liquid is low at low shear in slot curtain, the liquid may be dripped from the slit from a die as coating is temporary stopped during the operation due to adjustments or the like. When the viscosity is greater than 3,000 mPa·sec at low shear (shear rate of 1 $sec^{-1}$), (1) it is difficult to release air bubbles in the liquid to thereby cause bubble defects due to air bubbles in the liquid, (2) load to a feeding pump increases, as the pressure for ejecting the coating liquid increases, and therefore it is necessary to give pressure resistance to a feeding system.

In the present invention, the viscosity of the coating liquid is relatively low, in the case where the viscosity $\eta_1$ at low shear (shear rate of 1 $sec^{-1}$) is less than 300 mPa·sec, and therefore a proportion of a thinning of the curtain film caused by an influence of a boundary layer is small. There is no problem on practice, even when the edge guides of the curtain coating apparatus of the present invention are not used.

The viscosity can be measured, for example, by means of a B-type viscometer (product name: Vismetron VS-A1, manufactured by SHIBAURA SEMTEK CO., LTD.), or a pressure control rheometer VAR-100 (manufactured by Reologica Instruments AB).

A surface tension of the coating liquid is appropriately selected depending on the intended purpose without any limitation, but the surface tension thereof is preferably 20 mN/m to 40 mN/m.

When the surface tension is less than 20 mN/m, the tension of the film is weak as the surface tension of the film itself is weak, and therefore the film is easily deformed and waved by a disturbance by wind. When the surface tension is greater than 40 mN/m, moreover, the curtain film is cut upwards.

The surface tension can be measured, for example, by measuring static surface tension in accordance with a platinum plate method by means of a FACE automatic surface tensiometer (manufactured by Kyowa Interface Science Co., Ltd.). As described in the literature of Brown, A study of the behavior of a thin sheet of moving liquid J. Fluid Mechanics, 10:297-305, a dynamic surface tension of the curtain film can be measured by measuring a split angle of the curtain film, which is formed by inserting a needle-like object into the curtain film.

A mechanism of the cutting upwards of the curtain film is caused by a balance between a dynamic surface tension of the curtain film and dynamic pressure, and therefore it is important to measure and evaluate the dynamic surface tension of the film —Coating Liquid Outlet (Slot-Type Curtain Slit)—

A cross-sectional shape of the coating liquid outlet is a rectangular cross section.

A size of the coating liquid outlet is appropriately selected depending on the intended purpose without any limitation, but a gap of the slit is preferably about 0.2 mm to about 0.5 mm.

The gap of the slit has a function for making the coating liquid uniform along a width direction, and a size of the gap varies depending on a size and shape of a die manifold, a distance from the manifold to a slit outlet, a presence and position of a second manifold, and a flow rate or viscosity of the coating liquid, as described in "Slot Coating: Fluid mechanics and die design, Sartor, Luigi, Ph.D. University of Minnesota, 1990."

A material of the coating liquid outlet is appropriately selected depending on the intended purpose without any limitation, but the coating liquid outlet is preferably a metal plane, such as SUS, aluminum, and plating (e.g., hard chrome plating).

As for the material thereof, metal is preferable, as clogging is prevented even when a resin is contained in the coating liquid.

—Ejection System—

A slot die curtain used as an ejection system is used when one or two layers of a coating liquid are applied. As the slit faces downwards, in the case where the viscosity of the coating liquid is low, dripping of the liquid may be caused, or air bubbles in the liquid may be held in the manifold of the die head. However, as the ejection speed of the coating liquid is fast compared to slide die curtain, the slot die curtain is hardly cut upwards, considering a mechanism of cutting up of the curtain film. In the mechanism thereof, when the dynamic surface tension is large, the curtain film is cut upwards due to a balance between the dynamic surface tension of the coating liquid and dynamic pressure (inertial force) as the coating liquid falls. Moreover, it is easy to wash, and an amount of a washing liquid, such as water, used for washing is small, as there is less open space, such as a slide flow down surface. In the case where the viscosity of the coating liquid is high, moreover, it is also easy to temporally stop the operation.

—Coating Liquid Flow Rate—

A flow rate for ejecting the coating quid is appropriately selected depending on the intended purpose without any limitation, provided that the curtain film can be formed. There is no problem as long as the coating liquid is ejected at the intended flow rate, and shapes of the slit and manifold are the shapes with which a curtain film can be formed.

—Support—

The support is appropriately selected depending on the intended purpose without any limitation, provided that the coating liquid can be supported thereon.

A shape, structure, and size of the support are appropriately selected depending on the intended purpose without any limitation.

Examples of the support include release paper, base paper, synthetic paper, and a polyethylene terephthalate (PET) film.

<<Transporting Unit, Transportating Step>>

The transporting unit is a unit configured to transport the support, and the transportating step is a step containing transporting the support. The transporting unit is appropriately selected depending on the intended purpose without any limitation, and examples thereof include a transporting roller, and a transporting roller, and a transporting belt.

<<Guiding Unit, Guiding Step>>

The guiding unit is also called an edge guide, and contains a manifold portion configured to retain auxiliary water, and a slit portion connecting between the manifold portion and the auxiliary water outlet. The auxiliary water passes through the manifold, the straight-line portion of the slit portion, and then the curved portion of the slit portion, and is ejected substantially vertically downwards from the outlet, to thereby be introduced to a curtain film.

The guiding step is supporting both edges of a curtain film, which is formed of the coating liquid ejected from a coating liquid outlet, by a pair of guiding units each containing auxiliary water outlet configured to eject the auxiliary water, along a width direction that is substantially vertical to a flow-down direction of the curtain film, and guiding the curtain film onto a support to be transported.

—Auxiliary Water (Also Referred to as Edge Guide Water)—

The auxiliary water is appropriately selected depending on the coating liquid for use. An effect of retaining a curtain film with the edge guides, i.e., an aligning effect, is exhibited by pulling the coating liquid with the auxiliary water. Therefore the surface tension of the auxiliary water needs to be set always higher than the surface tension of the coating liquid. Examples of the auxiliary water include water in the case where the coating liquid is a water-based liquid, the same solvent to the one used in the coating liquid in the case where the coating liquid is a solvent-based liquid, and a blended liquid formed by blending a resin, a surfactant, etc. with water or a solvent.

—Manifold Portion—

The manifold portion may be a two stage manifold or a one stage manifold. As described in Slot Coating: Fluid mechanics and die design, Sartor, Luigi, Ph.D. University of Minnesota, 1990, a size of the manifold portion varies depending on a distance between the manifold portion and the slit outlet (auxiliary water outlet), and a flow rate or viscosity of the auxiliary water.

—Curved Portion of Slit Portion—

The curved portion is explained with reference to FIGS. 2 and 3. FIG. 2 is a cross-sectional view illustrating one example of a shape of the curved portion of the guiding unit in the slot curtain coating apparatus of the present invention. FIG. 3 is a cross-sectional view illustrating one example of an internal structure of the guiding unit in the slot curtain coating apparatus of the present invention.

Determining the thickness of the thinnest part of the upper part of the curved portion 32 as T, the curvature radius of the lower part of the curved portion 32 as R, and the gap of the slit portion as S as illustrated in FIG. 2, the curved portion of the slit portion preferably has the curvature radius R of 0.5 mm to 3 mm. When the curvature radius R is smaller than 0.5 mm, the flow is disturbed by an influence of a centrifugal force generated at the curved portion, the edge guide auxiliary water is not ejected uniformly, and therefore an effect of inhibiting an influence of a boundary layer cannot be exhibited. When the curvature radius R is greater than 3 mm, the distance h (h=T+R+S) from the top plane of the edge guide to the auxiliary water outlet becomes larger than 5 mm, and thus an influence of a boundary layer cannot be inhibited.

Accordingly, the curved portion 32 has the curvature radius R of 0.5 mm to 3 mm, and is provided at a position at which the height of the auxiliary water outlet from the top plane of the guiding unit, i.e., h=T+R+S is 1.5 mm to 5 mm.

Note that, a flow in a flow channel inside the guiding unit cannot be confirmed visually, and therefore the flow is evaluated through numerical analysis (Fluent).

—Straight-Line Portion of Slit Portion—

In order to shorten the distance h from the top plane of the guiding unit to the auxiliary water outlet, as illustrated in FIG. 2, considered are to reduce the curvature radius R of the curved portion 32, to reduce a gap of the slit portion, and to reduce the thickness T of the thinnest part of the upper part of the curved portion. As mentioned earlier, it has been known that the curvature radius R of the curved portion is set to 0.5 mm, and the minimum value of the gap of the slit portion is 0.2 mm. Therefore, h can be shortened even further by reducing the thickness T of the thinnest part of the upper part of the carved portion.

Meanwhile, the edge guide having a structure containing the manifold and the slit portion, as in the present invention, is composed of three plates (see FIG. 6A), and therefore the auxiliary water cab prevented from leaking from mating surfaces of the plates by holding together with bolts at the area which is at the top edge of the edge guide, and is as close as the slit portion.

However, the rigidity of the part of the guide unit at the upper side of the manifold portion and the slit portion is reduced by thinning the thickness T of the thinnest part of the upper part of the curved portion. Moreover, the plates cannot be held with bolts at the area adjacent to the slit portion, and therefore leakage may be caused from the mating surfaces of the plates.

In the present invention, a thickness T can be reduced with maintaining the rigidity of the part of the guide unit at the upper side of the manifold portion and slit portion, and therefore a cross-section area of the circular part 40 of FIG. 2 is increased by giving an angle θ with respect to the horizontal of the straight-line portion of the slit portion so that the plates can be held with bolts at the area adjacent to the slit portion.

Specifically, as illustrated in FIG. 2, the straight-line portion of the slit portion forms an angle (θ) with the top plane of the guiding unit. In the case where the slit portion is horizontal, a thickness of the upper part of the slit portion is constant. As the straight-line portion is inclined, the thickness of the upper part from the slit portion to the manifold portion can be gradually increased. By gradually increasing the thickness, the rigidity of the part of the guide unit at the upper side of the manifold portion and slit portion can be made higher than the case where the straight-line portion is horizontal. Therefore, it is possible to reduce the thickness T of the thinnest part. In view of processability, deformation caused by the internal pressure of the auxiliary water, or handling during operation, such as cleaning, the thickness T of the thinnest part needs to be about 0.8 mm or greater.

In order to realize the thickness T of the thinnest part required for attaining the desirable rigidity, the angle θ is preferably 30° to 60°. When the angle is smaller than 30°, the thickness T of the thinnest part cannot be made thin. When the angle thereof is greater than 60°, the length of the curved portion of the slit portion becomes large, and therefore a problem may be caused in handling, such as cleaning.

—Gap of Slit Portion—

As illustrated in FIG. 2, the gap S of the slit portion is preferably 0.2 mm to 0.5 rum, more preferably 0.2 mm to 0.4 mm. When the gap S is smaller than 0.2 mm, it is not easy to clean the inside of the outlet. When the gap S is larger than 0.5 mm, the ejection uniformity of the auxiliary water may be paired.

—Auxiliary Water Outlet—

Figure 6A:
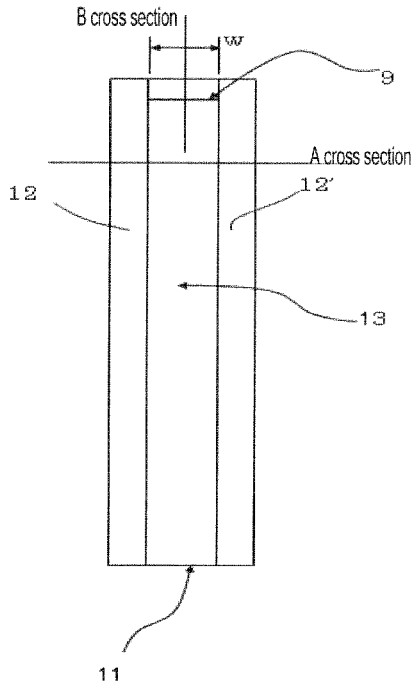
FIG. 6A is a front view illustrating one example of the guiding unit in the slot curtain coating apparatus of the present invention.

As illustrated an FIG. 6A, the maximum gap G of the auxiliary water outlet 9 with respect to the flow-down direction of the auxiliary water is appropriately selected depending on the intended purpose without any limitation, but the maximum gap G is preferably 0.2 mm to 0.5 mm, more preferably 0.2 mm to 0.4 mm.

When the maximum gap G is smaller than 0.2 mm, it is not easy to clean the inside of the outlet. When the maximum gap G is larger than 0.5 mm, the ejection uniformity of the auxiliary water may be impaired.

As illustrated in FIG. 6A, the maximum width w of the auxiliary water outlet 9 along a vertical direction to the flow-down direction of the auxiliary water is appropriately selected depending on the intended purpose without any limitation, but the maximum width w is preferably 1.5 mm to 4 mm, more preferably 2 mm to 3 mm.

When the maximum width w is smaller than 1.5 mm, a problem may be caused in accuracy upon processing. When the maximum width w is greater than 4 mm, the auxiliary water may not flow uniformly in the entire width.

The speed for introducing the auxiliary water is appropriately selected depending on the intended purpose without any limitation, provided that it is in the range at which the auxiliary water flows on a flow down surface. The speed thereof is preferably 0.4 m/sec to 2.1 m/sec, inure preferably 0.8 m/sec to 1.6 m/sec.

When the speed for introducing the auxiliary water is less than 0.4 m/sec, a boundary layer may be generated. When the speed thereof is greater than 2.1 m/sec, the auxiliary water may be introduced diagonally downwards.

A shape of the auxiliary water outlet 9 is a slit shape having a rectangular cross section. Originally, the flow channel of the auxiliary water inside the edge guide is preferably in the form of a long slit. However, if the slit is long, in the case where clogging is caused, it is difficult to clean, and practically, it is structurally difficult to provide a long slit inside.

—Auxiliary Water Flow-Down Groove (Concave Portion)—

Figure 6B:
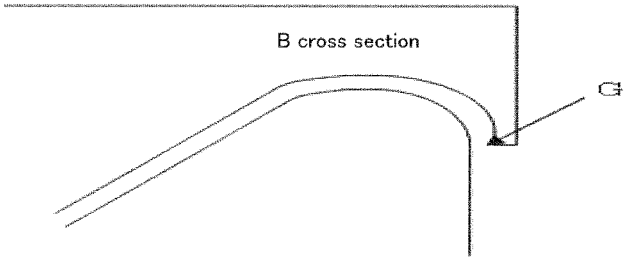
FIG. 6B is a cross-sectional view of B in FIG. 6A.
Figure 7:
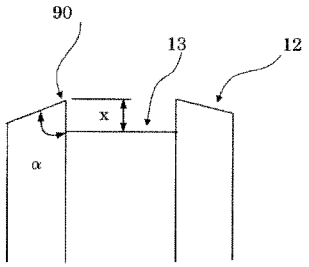
FIG. 7 is a cross-sectional view illustrating one example of the guiding unit in the slot curtain coating apparatus of the present invention.

The auxiliary water flow-down groove (concave portion) is explained with reference to FIGS. 6A, 6B, and 7. FIG. 6A is a front view illustrating one example of the guiding unit in the slot curtain coating apparatus of the present invention. FIG. 6B is a cross-sectional view of B in FIG. 6A. FIG. 7 is a cross-sectional view illustrating one example of the guiding unit of the slot curtain coating apparatus of the present invention, and is the cross-section view of A in FIG. 6A.

As illustrated in FIGS. 6A, 6B, and 7, the guiding unit 2 has auxiliary water flow-down groove (concave portion) 13 through which the auxiliary water flows downwards. As illustrated in FIG. 7, the auxiliary water flow-down groove (concave portion) 13 has a bottom surface, and concave portion side surfaces, each of which is formed substantially vertically with respect to the bottom surface.

Figure 8A:
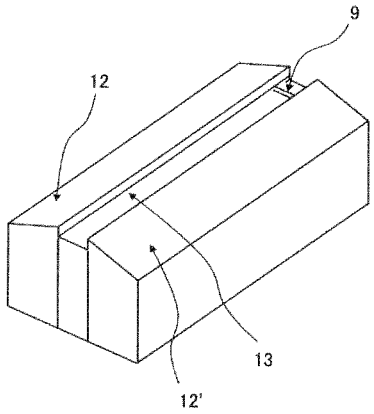
FIG. 8A is a perspective view illustrating one example of the guiding unit in the slot curtain coating apparatus of the present invention.
Figure 8B:
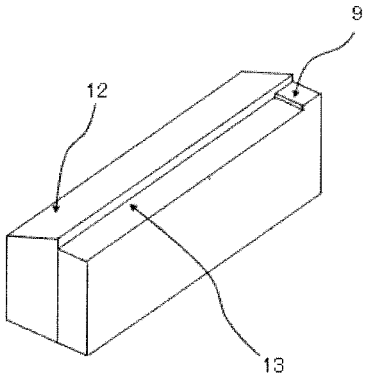
FIG. 8B is a partial perspective view of FIG. 8A.

The concave portion side surface and an exposed surface, which is formed to continue to the concave portion side surface, and to face the concave portion side surface, form an acute angle (α in FIG. 7). The concave portion 13, which is formed so that the exposed surface and the side surface form an acute angle, is provided continuously from the top plane to bottom plane of the guiding unit, as illustrated in FIGS. 8A and 8B. The acute angle is not particularly limited, as long as it is smaller than 90°, but it is preferably 30° to 80°, more preferably 45° to 60°.

When the acute angle is smaller than 30°, accuracy in processing may be adversely affected. When the acute angle is greater than 80°, an effect obtained by providing the acute angle may be impaired. When the acute angle is in the aforementioned preferable range, on the other hand, it is advantageous for retaining the edge guide auxiliary water.

The maximum depth (x in FIG. 7) of the auxiliary water flow-down groove (concave portion) is appropriately selected depending on the intended purpose without any limitation, but the maximum depth thereof is preferably 0.2 mm to 0.5 mm, more preferably 0.2 mm to 0.35 mm.

When the maximum depth x is smaller than 0.2 mm, the auxiliary water may be overflown from the auxiliary water flow-down groove (concave portion). When the maximum depth x is greater than 0.5 mm, a turbulent flow may be generated.

The maximum gap between the side surfaces of the auxiliary water flow-down groove (concave portion side surfaces) is appropriately selected depending on the intended purpose without any limitation, but it is preferably 1.5 mm to 4.0 mm, more preferably 2 mm to 3 mm.

When the maximum gap is smaller than 1.5 mm, it may be difficult for the auxiliary water to flow through the auxiliary water flow-down groove, and the auxiliary water may be overflown from the concave portion. When the maximum gap is greater than 4.0 mm, the curtain film may become unstable, and a turbulent flow may be generated at the bottom.

Note that, in the case where the auxiliary water outlet is provided from one side surface to the other side surface, the maximum gap of the concave portion is identical to the maximum width w of the auxiliary water outlet.

—Structure and Material of Guiding Unit—

Examples of a structure of the guiding unit include a structure where 3 plates (11, 12, 12') are combined, as illustrated in FIG. 6A. As illustrated in FIG. 3, the manifold portion 30, the straight-line portion 31, and the curved portion 32 are formed in the central plate 11. A leakage of the auxiliary water is prevented by sandwiching the central plate 11 between the two plates 12 and 12'.

Examples of a processing method for forming the manifold portion 30, and the straight-line portion 31 and curved portion 32 of the slit portion in the central plate 11 include wire cutting, and laser processing.

A material of the guiding unit is appropriately selected for use, but metal is preferable as clogging of the coating liquid can be prevented. Moreover, as for the central plate among the three plates, stainless steel is preferably used in view of processing accuracy, because processing accuracy is required as the gap S of the slit is narrow.

One example of the embodiment of the curtain coating apparatus and curtain coating method of the present invention is specifically explained with reference to drawings.

Note that, technically preferable various restrictions are mentioned, as the embodiment described below is the preferable embodiment of the present invention. However, the scope of the present invention is not limited to the embodiment described below, unless otherwise stated in the description below.

As illustrated in FIG. 4, the slot curtain coating apparatus of the present invention contains a slot curtain coating heat 1 (coating unit) containing a slot 7 configured to eject a coating liquid, edge guides (guiding unit) 2, and a transporting unit configured to transport a support 5. Moreover, the slot curtain coating head 1 contains a manifold 3 configured to retain the coating liquid 6 and a slot 7.

As illustrated in FIG. 3, the edge guide 2 is provided with a manifold portion 30 and a slit portion, and the slit portion is composed of a straight-line portion 31 and a curved portion 32. The auxiliary water is supplied to the manifold 30, and passes through the straight-line portion 31 of the slit portion, and the curved portion 32 of the slit portion, and the ejected substantially vertically downwards from the outlet 9.

As illustrated in FIG. 2, the height h of auxiliary water outlet 9 from the top plane of the edge guide 2 is determined as h=T+R+S, with a thickness T of the thinnest part of the upper part of the curved portion, a curvature radius R at the lower part of the curved portion of the slit, and a gap S of the slit portion. The curved portion 32 has the curvature radius R of 0.5 mm to 3 mm, and is provided at a position where the height (h=T+R+S) of the auxiliary water outlet 9 from the top plane of the edge guide is 1.5 mm to 5 mm.

As illustrated in FIG. 2, a flat part 9*a* in the size of about 0.2 mm is provided to an edge of the auxiliary water outlet 9 in order to eject the auxiliary water vertically downwards, and the edge of the plate part 9*a* is matched to the position of the outlet side of the curved portion of the slit portion.

The straight-line portion 31 of the slit portion forms an angle (θ in FIG. 2) of 30° to 60° with the top plane of the edge guide 2.

FIG. 3 illustrates an example where a one-stage manifold is provided, but there is no problem that a multiple stage manifold is provided. Note that, a bottom surface of the auxiliary water flow-down groove of the edge guide needs to have wettability capable of allowing the auxiliary water to uniformly fall downwards. In the case where the auxiliary water selected, materials of the edge guide needs to be appropriately selected. In view of processing accuracy, moreover, stainless steel is preferably used for a central plate 11. As for other materials, a metal surface, such as aluminum, and plating (e.g., hard chrome plating) is preferable. Materials of other parts may be a hydrophilic material, or a hydrophobic material.

As illustrated in FIG. 4, the coating liquid 6 is ejected from the manifold 3 and slot 7 to flow down as a curtain film 6 while both edges thereof are supported by the edge guides 2, and then hit on the support 5 to apply the coating liquid 6 thereon.

Meanwhile, the edge guide 2 has, at an upper part thereof, an auxiliary water outlet 9, which is configured to substantially uniformly eject the auxiliary water 10 downwards along the width direction of the auxiliary water flow-down groove (concave portion) 13 of the central plate 11, as illustrated in FIG. 4. The auxiliary water outlet 9 has a rectangular cross-sectional shape, and is provided vertical to the curtain film 6, and vertical to the fall-down direction of the curtain film 6.

The curtain film 6 flows down in the direction depicted with an arrow, and both edges thereof are supported with the auxiliary water 10 flown down in the auxiliary water flow-down grooves (concave portions) 13 of the edge guides 2.

The speed for introducing the auxiliary water 10 is set by varying the opening of the flow rate control valve (not illustrated), or an ejection amount of the pump.

At the bottom of the edge guide 2, an outlet (not illustrated) configured to discharge a mixed liquid of the auxiliary water 10 and the coating liquid, and a vacuum system (not illustrated) configured to enable the mixed liquid to discharge easily are provided. In order to prevent solidification of the coating liquid, the auxiliary water may be passed through the bottom of the edge guide 2.

As illustrated in FIG. 6A, the maximum width w of the auxiliary water outlet 9 is set to the maximum gap of the concave portion 13 of the edge guide 2. As illustrated in FIG. 7, x is determined as the maximum depth of the auxiliary water flow-down groove (concave portion) 13. The edge part 90 has an acute angle α. Nevertheless, a flat part in the side of about 0.1 mm may be provided at the edge considering a problem associated with processing accuracy, or a curved surface in the side of about several tens micrometers to about 100 μm may be formed at the edge in order to prevent burrs.

An aligning effect is exhibited owing to the surface tension of the auxiliary water by providing the auxiliary water flow-down groove (concave portion) 13, and therefore a curtain film, which is stable to disturbance, such as by wind, can be formed. Moreover, a formation of a boundary layer in the curtain film can be prevented further by introducing the auxiliary water in the flow-down direction along the edge curtain film 6, and introducing the auxiliary water at the introduction initial speed of 0.4 m/sec to 1.6 m/sec.

Note that, a distance between a pair of the edge guides provided the both side of the curtain film 6 with respect to the width direction thereof may be identical to a width of the coating liquid outlet (slot) of the slot curtain coating head 1, or may be narrower than the coating liquid outlet.

The slot curtain coating apparatus and slot curtain coating method of the present invention can inhibit an influence of a boundary layer, and can form a curtain film having a uniform film thickness.

EXAMPLES

The present invention is more specifically explained through Examples hereinafter, but Examples shall not be construed as to limit the scope of the present invention. Any modification appropriately applied to Examples is also included within the scope of the present invention, as long as it is in the spirit of the present invention.

In order to confirm an effect of the present invention, a slot curtain coating apparatus illustrated in FIG. 4, in which a size of a curved portion of an edge guide was varied, was produced, and an ejection state of auxiliary water, uniformity of a curtain film, and a flow rate distribution were evaluated.

Specific details of sizes of the curved portions of the edge guides of Examples 1 to 6 and Comparative Examples 1 to 4 are depicted in Table 3.

<Experiment Basic Conditions>

(1) Coating of Coating Liquid

The slot gap of the slot curtain coating head 1 was set to 0.4 mm, and the falling width of the curtain was set to 250 mm. The width of the coating liquid outlet (slot) of the slot curtain coating head 1 was 250 mm.

(2) Coating Liquid

As for a coating liquid, an acryl emulsion-based adhesive (product name: X-407-102E-10, manufactured by SAIDEN CHEMICAL INDUSTRY CO., LTD.) was used.

The viscosity of the coating liquid was 750 mPa·sec (as measured by a B-type viscometer, product name: Vismetron VS-A1, manufactured by SHIBAURA SEMTEK CO., LTD.), the viscosity thereof at the shear rate of 1 $sec^{-1}$ was 2,000 mPa·sec, and the viscosity thereof at the shear rate of 1,000 $sec^{-1}$ was 250 mPa·sec.

The static surface tension of the coating liquid was measured through a platinum plate method, by means of a FACE automatic surface tensiometer CBVP-A3 (manufactured by Kyowa Interface Science Co., Ltd.). As a result, the static surface tension was 33 mN/m.

(3) Flow Rate of Coating Liquid

A flow rate of the coating liquid was set to 1.25 cc/cm·sec (as measured by a flow meter for a coating liquid (product name: CN015C-SS-440K, manufactured by OVAL Corporation)).

(4) Shape and Material of Edge Guide 2

As for the edge guide 2, an edge guide composed of 3 plates, as illustrated in FIG. 6A, was used, in which the central plate was formed of stainless steel, and the manifold was a one-stage manifold.

As for the size of the edge guide 2, the length of flow down was 140 mm, the maximum width (w) of the introduction opening of the auxiliary water was 3 mm, the maximum depth (x) of the auxiliary ater flow-down groove (concave portion) was 0.25 mm, the maximum width of the auxiliary rater flow-down groove (concave portion) was 3 mm, and the acute angle ($\alpha$) was 60°.

A distance between the pair of the edge guides (an edge formed at an acute angle of the concave portion of one edge guide to an edge formed at an acute angle of the other edge guide) was 250 mm.

(5) Feeding of Edge Guide Auxiliary Water

A feeding rate of the edge guide auxiliary water was set to 50 mL/min.

The edge guide auxiliary water was supplied from the pressure tank compressed at 0.2 MPa to the edge guide 2 by means of a micro motion flow meter (manufactured by OVAL Corporation) (flow meter main body: E010S-SS-311, transmitter: RFT9739-3MD11, integrating meter: EL0122-132011) and a float-type flow meter (P100L-4, manufactured by TOKYO SEISO CO., LTD.). The opening of the throttle valve of the float-type flow meter was adjusted to give the auxiliary water flow down speed of about 1.1 m/s, which was determined by converting from the flow rate.

<Evaluation>

(1) Ejection Uniformity of Edge Guide Auxiliary Water

—Evaluation Criteria—

A: the auxiliary water was ejected almost uniformly

B: there was a slight disturbance in ejection of the auxiliary water

C: the auxiliary water a not ejected uniformly (2) Uniformity of Curtain Film

A curtain film was formed, and the light and shade of the film was visually observed with applying light from the opposite side of the curtain film, to thereby confirm the presence of a thin film part.

—Evaluation Criteria—

A: the curtain film was almost uniform along the width direction thereof

B: there was a slightly thick film part in the width direction of the curtain film C: there was a thick film part in the width direction of the curtain film (3) Flow Rate Distribution of Curtain Film in Width Direction —Flow Rate Measuring Method—

A plate of SUS304 having a thickness of 0.1 mm was folded to form a flume having a width of 8 mm, and a depth of 8 mm. The curtain film was blocked with the flume to measure an amount of the flume flow down liquid in a gravimetric method to thereby determine a fall down flow rate. The measured value was converted into a flow rate distribution by regulation, in which the flow rate obtained by converting the value of the flow meter with the flume width of 8 mm was determined as 100%.

—Evaluation Criteria—

A: the thickness of the thick film part was less than 105% relative to the average value B: the thickness of the thick film part was 105% or greater but less than 110% relative to the average value C: the thickness of the hick film part was 110% or greater relative to the average value (Experiment 1)

In order to make clear an effect of the curvature radius R at the bottom part of the curved portion of the slit portion, in Experiment 1, the edge guide auxiliary water was ejected from an edge guide whose R was varied to thereby confirm an ejection state. Moreover, a curtain film was formed under the experiment basic conditions, to thereby observe a film thickness of the curtain film.

In Example 1, the curvature radius Rat the bottom part of the curved portion was set to 1 mm, the gap S of the slit was set to 0.25 mm, and the thickness T of the thinnest part of the trapezoidal portion was set to 1.25 mm. As a result, the height h (=T+R+S) of the auxiliary water outlet from the top plane of the edge guide was 2.5 mm.

Example 2 was carried out in the same manner as in Example 1, provided that the bottom part of the curvature radius R of the curved portion was changed to 2 mm.

Example 3 was carried out in the same manner as in Example 1, provided that the bottom part of the curvature radius R of the curved portion was changed to 0.5 mm.

Example 4 was carried out in the same manner as in Example 1, provided that the bottom part of the curvature radius R of the curved portion was changed to 3 mm.

Comparative Example 1 was carried out in the same manner as in so Example 1, provided that the bottom part of the curvature radius R of the curved portion was changed to 4 mm.

Comparative Example 2 was carried out in the same manner as in Example 1, provided that the bottom part of the curvature radius R of the curved portion was changed to 0.4 mm.

Comparative Example 3 was carried out in the same manner as in Example 1, provided that the bottom part of the curvature radius R of the curved portion was changed to 0.3 mm.

(Results)

Figure 9:
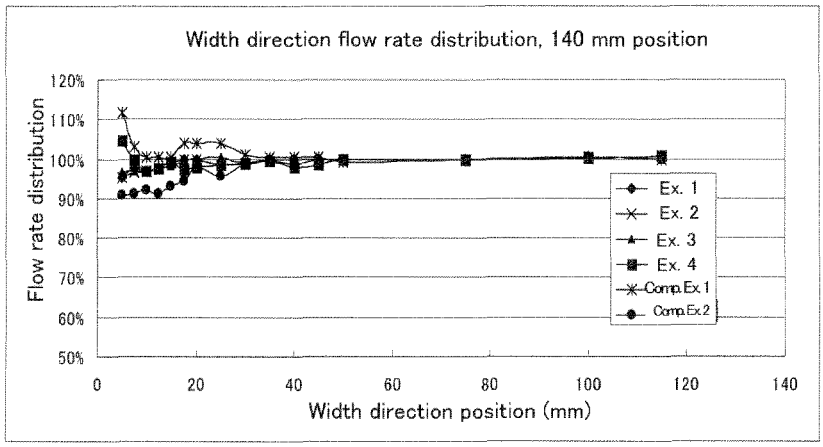
FIG. 9 is a graph depicting the evaluation results of the flow rate distribution of the curtain films of Examples and Comparative Examples in the width direction.

The evaluation results of Examples 1 to 4 and Comparative Examples 1 to 3 are presented in Table 1. Moreover, the flow rate distributions of the width direction of the curtain films are depicted in FIG. 9.

TABLE 1

| | Ejection state of auxiliary water | Evaluation | Uniformity of curtain film | Evaluation |
|---|---|---|---|---|
| Ex. 1 | Ejected desirably | A | Formed almost uniformly | A |
| Ex. 2 | Ejected desirably | A | Formed almost uniformly | A |

TABLE 1-continued

| | Ejection state of auxiliary water | Evaluation | Uniformity of curtain film | Evaluation |
|---|---|---|---|---|
| Ex. 3 | Ejected desirably | A | Formed almost uniformly | A |
| Ex. 4 | Ejected desirably | A | Formed almost uniformly | A |
| Comp. Ex. 1 | Ejected desirably | A | Thickened in the area adjacent to the edge guide | B |
| Comp. Ex. 2 | Slight disturbance in ejection of auxiliary water | B | Thickened in the area adjacent to the edge guide | B |
| Comp. Ex. 3 | Not ejected uniformly in the width direction | C | The film could not be formed as the auxiliary water was not ejected uniformly | C |

In Examples 1 to 4, the auxiliary water was ejected desirably, and the curtain film was also formed almost uniformly.

In Comparative Example 1, the auxiliary water was ejected desirably, but the curtain film was thinned in the area adjacent to the edge guide. This was caused probably because the height h of the auxiliary water outlet from the top plane of the edge guide was 5.5 mm in Comparative Example 1, and the curtain film received the influence of the boundary layer in the area between the auxiliary water outlet and the top plane of the edge guide.

In Comparative Example 2, the ejection of the auxiliary water was slightly disturbed, and the curtain film was thinned in the area adjacent to the edge guide.

In Comparative Example 3, the auxiliary water was not ejected uniformly in the width direction. This was caused probably because a centrifugal force affected the flow of the auxiliary water, as the curvature radius at the bottom part of the curved portion of the slit was small.

Moreover, a flow rate distribution in the width direction was measured. As a result, the result was matched to the result of the visual observation, as depicted in FIG. 9.

It was found from the results above, the curvature radius R at the bottom part of the curved portion of the slit was 0.5 mm to 3 mm, preferably 2 mm or smaller.

(Experiment 2)

In order to make clear a relation ship between the height h of the auxiliary water outlet from the top plane of the edge guide and uniformity of the curtain film, in Experiment 2, the edge guide auxiliary water was ejected using the edge guide whose h was varied, and the ejection state was confirmed. Moreover, a curtain film was formed under the experiment basic conditions, and a flow rate distribution of the curtain film in the width direction was measured.

In Example 5, the curvature radius Rat the bottom part of the curved portion was set to 0.5 mm, the gap S of the slit was set to 0.2 mm, and the thickness T of the thinnest part of the trapezoidal portion was set to 0.8 mm. As a result, the height h (=T+R+S) of the auxiliary water outlet from the top plane of the edge guide was 1.5 mm.

Example 6 was carried out in the same manner as in Example 5, provided that T was changed to 4.3 mm (h=5 mm).

Comparative Example 4 was carried out in the same manner as in Example 5, provided that T was changed to 5.3 mm (h=6 mm).

Note that, in the case where the thickness T is 0.8 mm or less, there is problem in processing. Therefore, such example was not carried out. When the thickness T of the thinnest part is 0.8 mm, the conditions thereof are identical to those of Example 5.

(Results)

Figure 10:
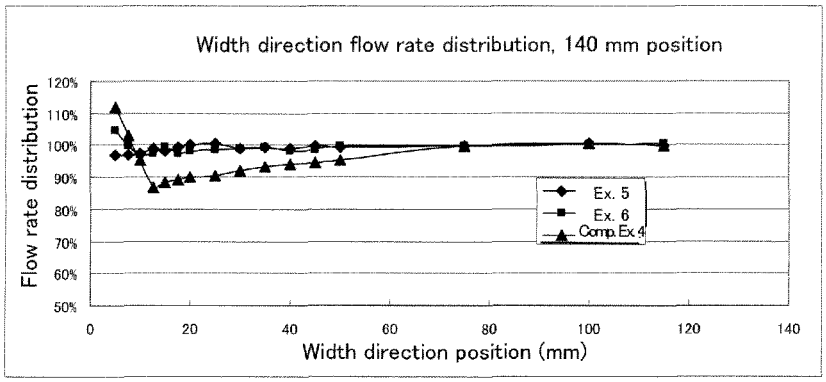
FIG. 10 is a graph depicting the evaluation results of the flow rate distribution of the curtain films of Examples and Comparative Examples in the width direction.

The evaluation results of Examples 5 and 6, and Comparative Example 4 are depicted in Table 2. Moreover, the flow rate distribution of the curtain film in the width direction is depicted in FIG. 10.

TABLE 2

| | Ejection state of auxiliary water | Evaluation | Flow rate distribution of curtain film in width direction | Evaluation |
|---|---|---|---|---|
| Ex. 5 | Ejected desirably | A | Less than 105% in the entire width | A |
| Ex. 6 | Ejected desirably | A | 105% or greater but less than 100% in the entire width | B |
| Comp. Ex. 4 | Ejected desirably | A | There are areas where it was 110% or greater | C |

In Example 5, the auxiliary water was ejected desirably, and the flow rate distribution of the curtain film in the width direction was less than 105% in the entire width, which was no problem.

In Example 6, the auxiliary water was ejected desirably, the flow rate distribution of the curtain film in the width direction was 105% or greater but less than 110% in the entire width, and a slightly thick film part was present. However, this degree of the thickness was not a problem on practical use after subjecting to a treatment, such as blowing off the edges of the coating film.

In Comparative Example 4, the flow rate distribution of the curtain film in the width direction was 110% or greater in the entire width, and the curtain film was thickened in the areas adjacent to the edge guides. This was caused probably because the curtain film received the influence of the boundary layer in the aforementioned areas, as the height h of the auxiliary water outlet from the top plane of the edge guide was 6 mm in Comparative Example 4.

It was found from the results above that the height h of the auxiliary water outlet from the top plane of the edge guide was 1.5 mm to 5 mm.

Table 3 is presented below.

TABLE 3

| | R | S | T | h |
|---|---|---|---|---|
| Ex. 1 | 1 mm | 0.25 mm | Thickness T = 1.25 mm | 2.5 mm |
| Ex. 2 | 2 mm | 0.25 mm | Thickness T = 1.25 mm | 3.5 mm |
| Ex. 3 | 0.5 mm | 0.25 mm | Thickness T = 1.25 mm | 2.0 mm |
| Ex. 4 | 3 mm | 0.25 mm | Thickness T = 1.25 mm | 4.5 mm |
| Ex. 5 | 0.5 mm | 0.2 mm | Thickness T = 0.8 mm | 1.5 mm |
| Ex. 6 | 0.5 mm | 0.2 mm | Thickness T = 4.3 mm | 5 mm |
| Comp. Ex. 1 | 4 mm | 0.25 mm | Thickness T = 1.25 mm | 5.5 mm |
| Comp. Ex. 2 | 0.4 mm | 0.25 mm | Thickness T = 1.25 nim | 1.9 mm |
| Comp. Ex. 3 | 0.3 mm | 0.25 mm | Thickness T = 1.25 min | 1.8 mm |
| Comp. Ex. 4 | 0.5 mm | 0. mm2 | Thickness T = 5.3 mm | 6 mm |

Test Example

The present invention exhibits an effect when a liquid having relatively high viscosity, such as an adhesive, is used.

In order to make clear an effect of the present invention with a difference in viscosity characteristics of the coating liquid, therefore, a curtain film was formed with varying the viscosity of the coating liquid under the experiment basic conditions, and a film thickness of the curtain film was observed.

As for a shape of the edge guide, the edge guide identical to the one in Example 1 was used.

In Test Example 1, the viscosity $\eta_1$ at the shear rate of 1 $sec^{-1}$ was set to 3,000 (mPa·sec), and the viscosity $\eta_2$ at the shear rate of 1,000 $sec^{-1}$ was set to 300 (mPa·sec).

In Test Example 2, the viscosity rp at the shear rate of 1 $sec^{-1}$ was set to 300 (mPa·sec), and the viscosity $\eta_2$ at the shear rate of 1,000 $sec^{-1}$ was set to 10 (mPa·sec).

In Test Example 3, the viscosity rp at the shear rate of 1 $sec^{-1}$ was set to 3,200 (mPa·sec), and the viscosity $\eta_2$ at the shear rate of 1,000 $sec^{-1}$ was set to 300 (mPa·sec).

In Test Example 4, the viscosity $\eta_1$ at the shear rate of 1 $sec^{-1}$ was set to 250 (mP·sec), and the viscosity $\eta_2$ at the shear rate of 1,000 $sec^{-1}$ was set to 10 (mPa·sec).

The evaluation results of Test Examples 1 to 4 are depicted in Table 4.

TABLE 4

| | Uniformity of curtain film |
|---|---|
| Test Ex. 1 | A curtain film was formed almost uniformly. |
| Test Ex. 2 | A curtain film was formed almost uniformly. |
| Test Ex. 3 | The liquid could not be ejected as the viscosity was high, and therefore a curtain film could not be formed. |
| Test Ex. 4 | A curtain film was uniformly formed, but dripping of the liquid was caused when the operation was terminated. |

In Test Examples 1 and 2, a curtain film was formed almost uniformly.

In Test Example 3, it was difficult to eject the liquid, as the viscosity thereof was high, and therefore a curtain film could not be formed.

In Test Example 4, a curtain film was formed almost uniformly, but this was because an influence of a boundary layer became small when the viscosity was low, and a ratio of thinning the curtain film was small. In the case where the viscosity is low, therefore, an effect of the present invention is small. As the dripping of the liquid was caused at the time when the operation was terminated, it was considered that there was a problem for use on the operation.

It was found from the results above that, as for the viscosity characteristics of the coating liquid, which exhibited the effect of the present invention, the viscosity $\eta_1$ at the shear rate of 1 $sec^{-1}$, and the viscosity $\eta_2$ at the shear rate of 1,000 $sec^{-1}$ were respectively $300 \leq \eta_1 \leq 3{,}000$ (mPa·sec), and $10 \leq \eta_2 \leq 300$ (mPa·sec). Specifically, even in the case where a coating liquid having a strong shear viscosity reducing effect is used, a curtain film having a uniform film thickness can be attained without being influenced by a boundary layer, by using the slot curtain coating apparatus and slot curtain coating method of the present invention.

The slot curtain coating apparatus and slot curtain coating method of the present invention can be suitable used, for example, for productions of an adhesive label to which an adhesive has been applied, a silver halide photographic photosensitive material, a magnetic recording material, pressure sensitive or heat sensitive recording paper, art paper, coated paper, and an inkjet recording sheet.

The embodiments of the present invention are, for example, as follows:

<1> A slot curtain coating apparatus, including:

an ejecting unit containing a coating liquid outlet configured to eject a coating liquid;

a pair of guiding units, each containing an auxiliary water outlet configured to eject auxiliary water, where the guiding units are configured to support both edges of a curtain film, which is formed of the coating liquid ejected from the coating liquid outlet, along a width direction that is substantially vertical to a flow-down direction of the curtain film, and to guide the curtain film onto a support to be transported; and a transporting unit configured to transport the support, wherein the guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and his a height of the auxiliary a outlet from a top plane of the guiding unit.

<2> The slot curtain coating apparatus according to <1>, wherein the straight-line portion forms an angle of 30° to 60° with the top plane of the guiding unit.

<3> A slot curtain coating method, containing;

ejecting a coating liquid from a coating liquid outlet;

supporting both edges of a curtain film, which is formed of the coating liquid ejected from a coating liquid outlet, by a pair of guiding units each containing an auxiliary water outlet configured to eject the auxiliary water, along a width direction that is substantially vertical to a flow-down direction of the curtain film, and guiding the curtain film onto a support to be transported, and transporting the support, wherein the guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and his a height of the auxiliary water outlet from a top plane of the guiding unit.

<4> The slot curtain coating method according to <3>, wherein the straight-line portion forms an angle of 30° to 60° with the top plane of the guiding unit.

<5> The slot curtain coating method according to any of <3> or <4>, wherein the coating liquid is a fluid that reduces apparent viscosity thereof as a shear rate increases, and satisfies:

$$300 \leq \eta_1 \leq 3{,}000 \text{ (mPa·sec), and}$$

$$10 \leq \eta_2 \leq 300 \text{ (mPa·sec)}$$

where $\eta_1$ is a viscosity of the coating liquid at a shear rate of 1 $sec^{-1}$, and $\eta_2$ is a viscosity of the coating liquid at a shear rate of 1,000 $sec^{-1}$.

<6> The slot curtain coating method according to any one of <3> to <5>, wherein the coating liquid is an acryl emulsion-based adhesive.

This application claims priority to Japanese application No. 2013-053145, filed on Mar. 15, 2013 and incorporated herein by reference.

What is claimed is:

1. A slot curtain coating apparatus, comprising:

an ejecting unit containing a coating liquid outlet configured to eject a coating liquid;

a pair of guiding units, each containing an auxiliary water outlet configured to eject auxiliary water, where the pair of guiding units are configured to support both edges of a curtain film, which is formed of the coating liquid ejected from the coating liquid outlet, along a width direction that is substantially vertical to a flow-down direction of the curtain film, and to guide the curtain film onto a support to be transported; and a transporting unit configured to transport the support, wherein each guiding unit amongst the pair of guiding units has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and h is a height of the auxiliary water outlet from a top plane of each guiding unit.

2. The slot curtain coating apparatus according to claim 1, wherein the straight-line portion forms an angle of 30° to 60° with the top plane of each guiding unit.

3. A slot curtain coating method, comprising:

ejecting a coating liquid from a coating liquid outlet;

supporting both edges of a curtain film, which is formed of the coating liquid ejected from a coating liquid outlet, by a pair of guiding units each containing an auxiliary water outlet configured to eject auxiliary water, along a width direction that is substantially vertical to a flow-down direction of the curtain film, and guiding the curtain film onto a support to be transported, and transporting the support, wherein each guiding unit has a manifold portion configured to retain the auxiliary water, and a slit portion connecting between the manifold portion and the auxiliary water outlet, wherein the slit portion is composed of a straight-line portion, and a curved portion configured to eject the auxiliary water substantially vertically downwards, and wherein the curved portion is provided to a position at which h=T+R+S is 1.5 mm to 5 mm, where T is a thickness of the thinnest part of a top part of the curved portion, R is a curvature radius of a bottom part of the curved portion and is 0.5 mm to 3 mm, S is a gap of the slit portion, and his a height of the auxiliary water outlet from a top plane of each guiding unit.

4. The slot curtain coating method according to claim 3, wherein the straight-line portion forms an angle of 30° to 60° with the top plane of each guiding unit.

5. The slot curtain coating method according to claim 3, wherein the coating liquid is a fluid that reduces apparent viscosity thereof as a shear rate increases, and satisfies:

$$300 \leq \eta_1 \leq 3{,}000 \text{ (mPa·sec), and}$$

$$10 \leq \eta_2 \leq 300 \text{ (mPa·sec)}$$

where $\eta_1$ is a viscosity of the coating liquid at a shear rate of 1 $sec^{-1}$, and $\eta_2$ is a viscosity of the coating liquid at a shear rate of 1,000 $sec^{-1}$.

6. The slot curtain coating method according to claim 3, wherein the coating liquid is an acryl emulsion-based adhesive.

* * * * *